United States Patent [19]

Baglio

[11] Patent Number: 4,854,530

[45] Date of Patent: Aug. 8, 1989

[54] HANGER SYSTEM FOR FLEXIBLE PLASTIC BAGS

[76] Inventor: Thomas P. Baglio, 1060 E. Grand Ave., Escondido, Calif. 92025

[21] Appl. No.: 279,450

[22] Filed: Dec. 2, 1988

Related U.S. Application Data

[63] Continuation-in-part of Ser. No. 101,974, Sep. 28, 1987.

[51] Int. Cl.[4] ..... B65B 67/12

[52] U.S. Cl. ..... 248/95; 248/311.2

[58] Field of Search ..... 248/95, 99, 101, 311.2, 248/311.3, 318, 312, 340; 211/88, 71; 223/95

[56] References Cited

U.S. PATENT DOCUMENTS

| | | | |
|---|---|---|---|
| 1,286,940 | 12/1918 | Cerny | 248/95 |
| 1,899,942 | 3/1933 | Claflin | 211/48 X |
| 2,287,473 | 6/1942 | Glines | 223/95 X |
| 2,447,771 | 8/1948 | Rogers | 248/95 X |
| 2,816,667 | 12/1957 | Tanay | 248/312 X |
| 3,001,678 | 9/1961 | Maxwell | 248/312 X |
| 4,325,486 | 4/1982 | Neal | 211/71 |
| 4,540,146 | 9/1985 | Basile | 248/318 X |
| 4,700,849 | 10/1987 | Wagner | 211/71 |

FOREIGN PATENT DOCUMENTS

| | | | |
|---|---|---|---|
| 1347666 | 2/1974 | United Kingdom | 211/45 |

*Primary Examiner*—J. Franklin Foss

*Attorney, Agent, or Firm*—Dressler, Goldsmith

[57] ABSTRACT

A hanger system hangs flexible plastic bags by an increased thickness of plastic near the tops of the bags. The bags' increased thickness results from ridges of slightly thicker plastic wall at the top of the bag, such as is common to rib and groove bag closures. Bags are supported downhanging from slots defined between adjacent rails, or fingers. The width of the slot is normally such as to maintain a downhanging bag securely closed, but may be widened over a short region. The seal of the bag may be opened at this widened region and material, particularly liquids and gases, may be inserted into or extracted from the cavity of the downhanging bag, particularly by use of a tube, or straw.

19 Claims, 2 Drawing Sheets

FIG. 1
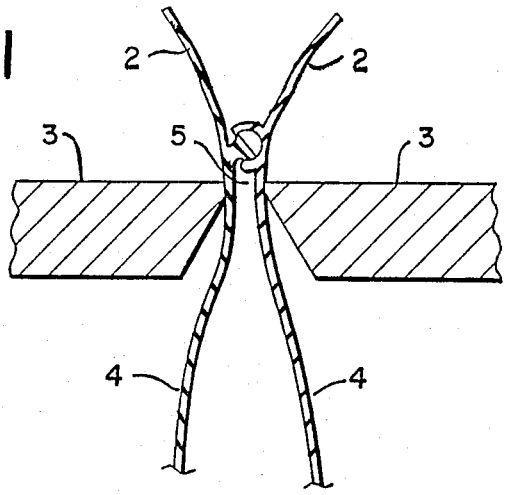
FIG. 2
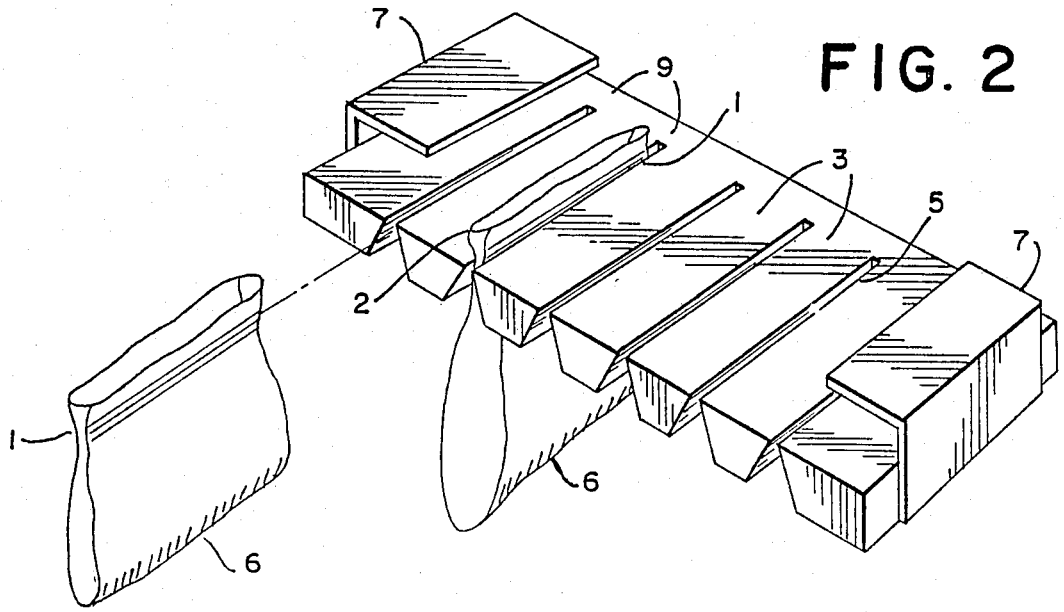
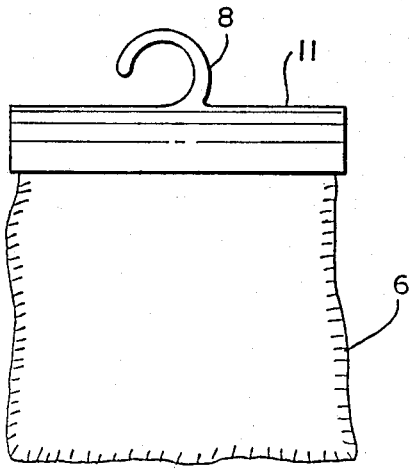
FIG. 3
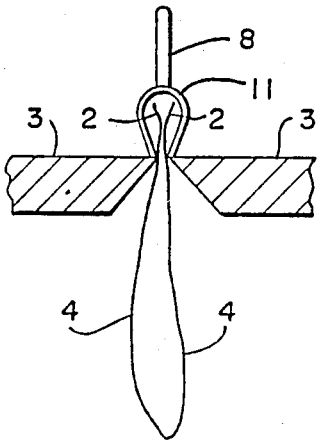
FIG. 4

FIG. 5
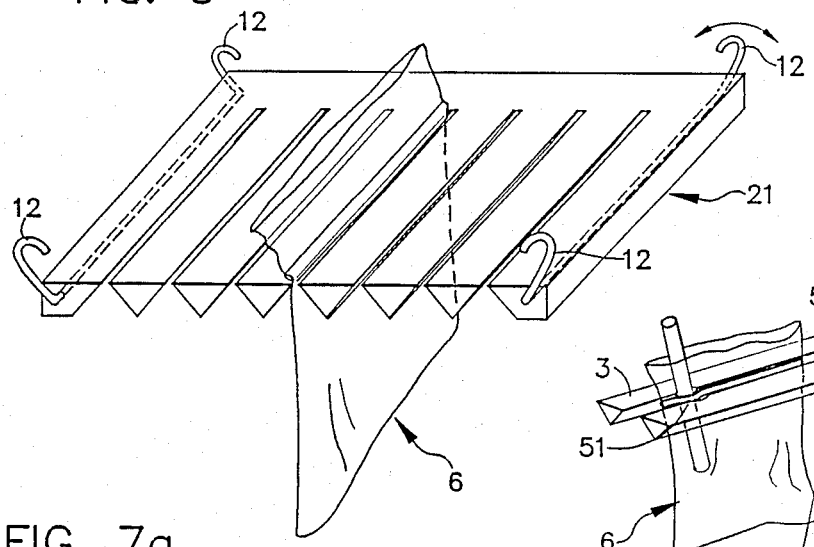
FIG. 6
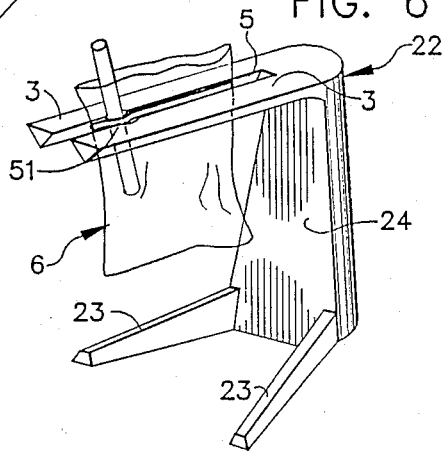
FIG. 7a
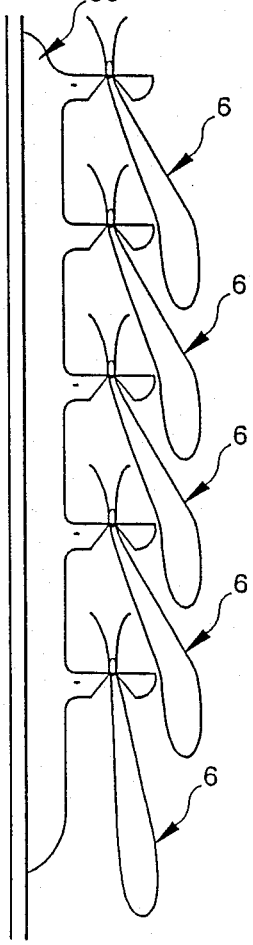
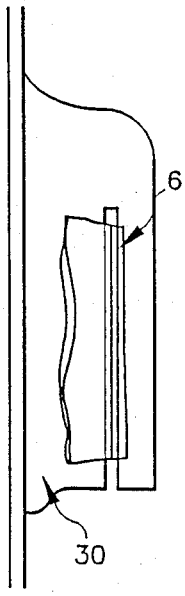
FIG. 7b
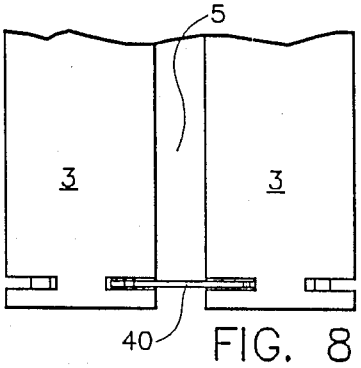
FIG. 8
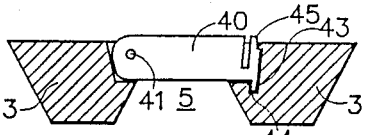
FIG. 8a
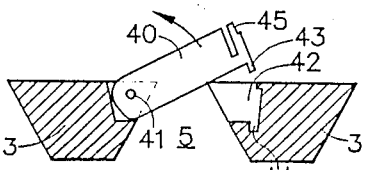
FIG. 8b

HANGER SYSTEM FOR FLEXIBLE PLASTIC BAGS

The present invention is a continuation-in-part of U.S. patent application Ser. No. 07/101,974 filed Sept. 28, 1987 now an allowed application.

BACKGROUND OF THE INVENTION

1. Field of the Invention

The present invention concerns devices and systems for supporting plastic bags and their contents by hanging, especially plastic bags having a reclosable seal.

2. Background of the Invention

Flexible plastic bags have long been used for holding, protection, and/or storage of various contents including, but not limited to, food, hardware, clothes, chemicals, paper goods and many other items.

Certain of the previous bags have an additional thickness of material near the top of the bag. One common reason for the additional thickness is the presence of an interlocking rib and groove bag closure mechanism near the top of the bag. Such a closure mechanism is efficient and effective, but does not itself solve the problem of efficiently arranging and maintaining the bags and their contents during storage.

Some previously known plastic bags present an integral hanger, or a hoe in the bag material, for hanging the bag during storage. The hanger or hole was typically located in a region of the bag extending from that region where the bag holds its contents. This extension region uses extra material, and consumes extra space, without supporting the content-holding function of the bag.

Meanwhile, other previous plastic bags that had neither a hanger nor a hole were required to be laid on something for storage. The resulting stacked storage takes considerable space and is correspondingly inefficient. Additionally, the contents of the stacked bags are not easily viewed while individual bags other than the topmost can only be removed with difficulty.

It is also previously known to store bags vertically by hanging them from a rack or support. The plastic bags so stored exhibit a perforation of the bag or an integral attached hanger. Because their was no complementary interaction of the bag closure mechanism and the hanging mechanism, the maintenance of the closure of the bag along its seal was not assured simply because the bag was hung.

Previously known plastic bags have not been consistently and reliably removable from their hangers, openable and closable, and returnable to the same hanger multiple times without undue wear or deterioration that may result in leakage of the bags' contents.

SUMMARY OF THE INVENTION

The present invention is embodied in a hanger system for plastic bags. The system includes a hanger rack assembly that supports a flexible plastic bag suspended downhanging from an increased thickness of material at or near the top of the bag. The increased thickness of material is preferably due to the plastic that is used in molding a rib and groove type closure mechanism.

The increased thickness of material may alternatively be due to a handle mechanism that is typically made of molded plastic. One embodiment of the handle mechanism clenches a plastic bag of substantially uniform thickness at its upper regions. In this embodiment the handle mechanism has a channel that clasps the bag under tension within the channel's interior. Alternatively, in another embodiment the handle mechanism's channel has a predetermined width of separation. In this embodiment the handle mechanism's channel slides along a plastic bag that exhibits the increased thickness of material and thereafter holds the bag from its thickened region. The exterior of either hanger mechanism forms a hanger hook. The hanger hook permits hanging of the bag upon such times as the bag and its handle mechanism are not supported downhanging by the hanger rack assembly.

In the preferred embodiment of the hanger rack assembly of the invention, the additional thickness of the plastic bag at its top region is supported on appropriately separated spaced parallel rails. The rails are positioned along each side of the bag and preferably extend along the entire length of the bag's top. The hanger rack assembly's rails each define a side of a slot that is of suitable width for holding the bag. The rails are held rigidly in a proper spaced parallel spatial relationship to each other by bridging material. This bridging material is located either at the rear or on the top of the hanger assembly in a position where it does not interfere with support or removal of the bag.

The use of the hanger system is as follows. A flexible plastic bag that has the required increased thickness at or near its top region is opened and contents are placed inside the bag. The bag is then closed, preferably along its rib and groove closure mechanism. The bag is then slid into the slot of the hanger rack assembly so that the extra thickness of the bag is positioned above the rails of the hanger rack assembly. The bag is released allowing the bag and its contents to be suspended downhanging on the rails of the hanger rack assembly. The inward pressure of the hanger rack assembly's rails on each side of the bag at the location of the bag's additional thickness tends to maintain the sides of the bag closely proximate, thereby maintaining the seal of the bag reliably closed.

The hanger rack assembly may be variously supported. It may be hung from brackets that grasp a solid planar shelf, such as a glass refrigerator shelf, at its edges. It may be hung from upwardly extending hooks, normally made of wire, that hook an apertured overhead support surface, such as a wire refrigerator shelf, through its apertures. It may be supported by a free-standing base, such as at the top of a base formed from a vertical column that is connected to splayed legs that rest upon a level planar surface. Finally, the hanger rack assembly itself may be made in a substantially vertical, as opposed to a horizontal, configuration. In this vertical configuration a vertically tiered array of rails support a correspondingly vertically tiered array of hanging plastic bags.

In one embodiment of the hanger rack assembly the substantially uniform spaced parallel separation of the rails may exhibit a small widened region. The region is normally sufficiently small so as to not interface with the rails' support of the hung bag, and is commonly the approximate diameter of a common drinking straw. The bag's seal may be broken at the widened region so that material, especially liquids and gases, may be either withdrawn from or inserted into the downhanging bag by tubes, syringes, or similar fluid conduits. Expanding air and liquid vapors resultant from heating of the bag's contents, such as during microwave cooking, are allowed to escape.

In another embodiment of the hanger rack assembly the downhanging bags may be retained within their slots, and the rails may be positionally stabilized, by a pivoting arm that selectively closes the open end of the slots by bridging between adjacent rails.

BRIEF DESCRIPTION OF THE DRAWINGS

FIG. 1 is a cross sectional view showing a hanger rack assembly, including rails defining a slot suitable for supporting a flexible plastic bag, of the hanger system of the present invention.

FIG. 2 is a top-front-right perspective view of a first embodiment of a multiple bag hanger rack assembly, including brackets to attach the hanger rack assembly under a solid planar shelf, of the hanger system of the present invention.

FIG. 3 is a side view showing an individual, single bag, hanger hook mechanism clamped to a bag wherein the hanger hook mechanism and its held bag are compatibly employed with the hanger rack assembly of the present invention.

FIG. 4 is an end cross sectional view showing the individual, single bag, hanger hook affixed to a bag in position hanging from the hanger rack assembly shown in FIGS. 1 and 2.

FIG. 5 is a perspective view of a second embodiment of a multiple bag hanger rack assembly, including hooks to attach the hanger rack assembly under an apertured support shelf, of the hanger system of the present invention.

FIG. 6 is a perspective view of a single bag freestanding hanger rack assembly of the hanger system of the present invention.

FIG. 7*a* is a side plan view of a third embodiment of a multiple bag hanger rack assembly of the hanger system of the present invention.

FIG. 7*b* is a top plan view of the third embodiment of the multiple bag hanger rack assembly.

FIG. 8, consisting of FIG. 8*a* through FIG. 8*c*, is a detail view of an optional closure mechanism for retaining plastic bags locked within hanger rack assemblies of the hanger system of the present invention.

DETAILED DESCRIPTION OF THE INVENTION

The present invention is embodied in a hanger system. Within the system a hanger rack assembly hangs or supports in a vertical position flexible plastic bags that exhibit a region of increased thickness at or near the top of the bag.

The hanger rack assembly has rigid rails, or fingers, defining each side of one or more slots. Each slot is wide enough to pass the normal thickness of two typically thin sides of the plastic bag. However, each slot is insufficiently wide to pass the greater thickness of the plastic bag at the region of increased thickness at or near the top of the bag. Thus, once a plastic bag is inserted into a slot by sliding along a bag region of normal thickness, the bag and its contents may thereafter hang suspended between the rails by support of the bag's region of increased thickness upon the rails.

Three or more rails can be arrayed one to the next to form a plurality of slots for holding a like plurality of bags. Alternatively, there may be only one pair of rails with one slot between them allowing the hanging of only one bag. The rails are normally joined and maintained in a spaced parallel spatial relationship by a rigid bridging between rails. The slot and the rails are typically long enough to permit the whole top of the bag to slide, lengthwise, into the slot with some overlap for security. At least one end of the hanger rack assembly is open to receive the bag. The end(s) of the rails where the bag is received are typically flared, or in some other way enlarged, so as to aid in starting the slide of the walls of the bag into the slot.

The hanger rack assembly normally has some means of mounting it to another surface. It is typically either removably mounted by action of a hook or loop on the hanger rack assembly's upper surface that permits it to be hung loosely below a supporting bar, rack, or shelf of some kind. Alternatively, it may be hung more rigidly by action of a bracket that permits the hanger rack assembly to be firmly fastened under a shelf with screws or bolts. When the hanger rack assembly is mounted to another surface then a same end of all the slots is typically left open for insertion and removal of bags from a single direction.

Various embodiments of hanger rack assemblies in accordance with the present invention are shown in FIGS. 2, 5, 6 and 7. Each hanger rack assembly defines rigid rails, or fingers, 3 such as are shown for the first embodiment of the hanger rack assembly 20 in FIGS. 1 and 2. These rails 3 border and define a slot 5 between them. This slot 5 is of the proper width to permit two adjacent thicknesses of the wall material 4 of bag 6 to pass into the slot 5. The rails 3 are of sufficient length so as to allow the entire length of the top of the bag 6 to be slid between them as is shown in FIG. 2. The bag 6 is preferably made of plastic, but other materials such as metal foil are suitable.

The edges of the rails 3 that are in contact with the walls of the bag 6 are preferably smooth so as to avoid cutting the bag, but are sharp enough to reliably grasp the extra thickness of the bag 6 at its region 1. This bulk of additional thickness 1 rests on the rails 3 along the whole length of the top of the bag 6 as is shown in FIG. 2. The top region 2 of the bag 6 is free to stick out on top of the rails 3. The content-holding portion of the bag 6 hangs below the rails 3.

The bag 6 may be removed and replaced from the hanger rack assembly 20 by sliding it out or into each slots between the rails 3. The rails 3 are held in relation to each other by a bridge 9 of material extending from one rail to another. This bridge 9 can be over the top of the hanger rack assembly 20 or at the rear of the hanger rack assembly 20 as shown in FIG. 2. In the case of a top bridge then it must be sufficiently wide, high, and far enough away from the edges of rails 3 to permit the top region 2 of the plastic bag, and the bag attachment mechanism 8 (to be discussed), to fit under the bridge. Alternately, there may be a several slots 5 with rails 3 on each side that are joined together by a common rear bridge 9. This type of hanger rack assembly 20 serves for multiple bag storage.

The hanger system in accordance with the present invention additionally accords for a hanger, or attachment, mechanism to also clasp the bag. This hanger mechanism 11, shown in FIGS. 3 and 4, permits the bag 2 to be supported by something other than the human hand when it is withdrawn from the hanger rack assembly 20. The channel defined by the hanger mechanism 11 may exhibit either a substantially zero width, or a small finite separation, in different embodiments. In the case of zero width the sides of the channel are elastic and the channel spreads to admit a plastic bag 6 and thereafter grasp it under tension. In the case of a finite width the plastic bag 6 is supported within the channel of the hanger mechanism 11 at its thickened region. The variably predetermined width of the hanger mechanism 11 may serve to adapt plastic bags 6 of widely varying wall thicknesses, and widely varying thicknesses of their thickened regions, to a hanger rack mechanism 20 that has a uniform, relatively wide, width of its slot 5.

The top of hanger mechanism 11 presents a closed loop, or a hook, which permits hanging of the hanger mechanism 11 and its supported bag 6 from a rack or a rod of some kind (not shown). Both the hanger mechanism 11 and the supported bag 6 may be removed, either separately or together, from the rails 3 of the hanger rack assembly 20. The hanger mechanism 11 preferably has an open loop type means for hanging, such as the hook 8 shown in FIGS. 3 and 4.

Another, second, preferred embodiment of a multiple bag hanger rack assembly of the hanger system in accordance with the present invention is shown in FIG. 5. A hanger rack assembly 21 exhibits a plurality of rails 3 capable of supporting a like plurality minus one of bags 6 at a like plurality minus one of slots 5. The hanger rack assembly 21 is supportable below an overhead support (not shown) by hanging from hooks 12. The hooks 12 hook apertures within the overhead support, such as within the apertures of a wire refrigerator shelf. The hooks 12 are normally of strong wire. They preferably extend through the end regions of the body of the hanger rack assembly 21, as illustrated, in order to accord strength in their attachment to the hanger rack assembly 21. The hooks 12 normally pivot about the axis of their connections to the hanger rack assembly 21, and may thus hook an overhead support of varying dimensions.

An embodiment of a free-standing hanger rack assembly 22 of the hanger system in accordance with the present invention is shown in FIG. 6. The hanger rack assembly 22 particularly supports one bag 6 between two rails 3. The construction of a free-standing hanger rack assembly 22 could obviously be extended to support a plurality of bags 6. In the details of its preferred construction, the hanger rack assembly 22 has multiple, preferably two splayed, elongate legs 23 that connect to a vertical column 24 in order to form a base. This base is typically connected to the supporting rails 3 at their rear ends, but could alternatively be connected to the side of one or both rails. The rails 3, and bag 100, are supported at a sufficient height above a support surface so as to allow bag 100 to be suspended downhanging without contacting the surface. The legs 23 are preferably disposed about a point where an imaginary line that is orthogonal to the surface on which the legs rest, and that passes through the combined center of gravity of the hanger rack assembly 22 and the filled bag 6, would intersect the plane of the surface. The legs 23 are preferably angled relative to each other, or are connected by a joining member (not shown), so that they subtend considerable area and may be supported upon a parallel wire grid, or wire refrigerator shelf, (not shown) without slipping between adjacent wires.

In accordance with the present invention, the channel 5 between the rails 3 of the hanger rack assembly 21 shown in FIG. 6 exhibits a widened region 51. The region 51 is generally cylindrical with a generally vertical axis generally centered on the plane of the bag 100. It is typically the diameter of a common drinking straw. The seal to the bag 6 may be opened at the area of widened region 51, and is preferably maintained open by a tube, such as a straw or straw segment, 16. The tube 16 permits the ingress and egress of gaseous and liquid fluids, and small solid bodies, between the interior and exterior of bag 6 while the bag 6 is held within the hanger rack assembly 21. This ingress and egress of material is useful for filling or emptying the bag 6, or for allowing expansion of the contents of the bag 6 during heating. For example, the tube 16 may permit the escape of air and liquid (water) vapor during microwave popping of popcorn contained with the cavity of bag 6.

Similarly, other foods may be cooked at a boil. The tube 16 can be both inserted and withdrawn while the bag 6 is held within the hanger rack assembly 21 by act of regionally opening, and reclosing, the seal to the bag 6 at the widened region 51. The widened region 51 is obviously adaptable to other embodiments of the hanger rack assembly in accordance with the present invention.

Access to the interior of bag 6 through tube 16 while it is supported on hanger rack assembly 21 is useful for adding or removing contents from the bag without spilling, and with observable precision as to amount. Completely filling a plastic bag having an interlocking rib and groove seal with liquid, or with a slurry such as applesauce, is very difficult when the bag is only supported by the hands. The access supported by the present invention permits reliable and easy full filling of a sealable plastic bag. If desired, air can be evacuated from a bag already containing contents by applying a negative pressure, or sucking, on that end of tube 16 that is exterior to the bag. The seal of the bag can normally be pinched shut against the tube, which is then forcibly withdrawn while the bag's seal is closed, without undue seepage of air into the evacuated cavity of the bag.

A third embodiment of a multiple bag hanger rack assembly in accordance with the present invention is shown in side plan view of FIG. *7a*, and in top plan view of FIG. *7b*. The bag hanger rack assembly 30 supports a plurality of plastic bags 6 in a substantially vertical tiered array. Each bag may be individually slid in and out of a corresponding slot upon the bag hanger rack assembly 30, and suspended downhanging, without undue interference to adjacent ones of the bags 6. The contents of each bag 6 remain visible despite the simultaneous hanging of many such bags.

An optional closure mechanism that is usable or any embodiment of a hanger rack assembly in accordance with the present invention is shown in detail view in FIG. 8. An arm 40 pivots about a pivot point 41, preferably in the vertical plane but also optionally in a horizontal plane, between positions alternatively opening, and closing, ingress and egress from channel 5. The distal end of arm 40 snaps into a complementary cavity 42 in the end of a first rail 3. A second rail 3 having pivot point 41 is opposed to the first rail across the width of channel 5. The closed and snap-locked position of arm 40 secures a bag 6 within the hanger rack assembly.

The distal end of arm 40 preferably exhibits a hook, or spur, 43 that latches a complementary region 44 within the cavity 42 in order to keep the rails 3 from separating (such as under spreading force from a suspended bag 6) during use and storage of a hanger rack assembly. The distal end of arm 40 further preferably exhibits a springloaded, or tensionable, catch 45 that abuts against a complementary notch feature within the cavity 42 of rail 3. The catch 45 maintains the arm 40 in its closed position until manually unsprung.

In accordance with the preceding teaching, still other embodiments and variations of the present invention will suggest themselves to a practitioner of the mechanical arts. For example, a hanger rack assembly could be made in a circular configuration, and could rotate to bring supported bags to a forward position. For example, a single slot could support a plurality of bags. For example, the pivoting arm could keylock in its closed position.

In accordance with these and other possible adaptations and variations of the present invention, the invention should be interpreted in accordance with the following claims, only, and not solely in accordance with those preferred embodiments within which the invention has been taught.

What is claimed is:

1. A hanger for a reclosable bag having a substantially straight marginal seal that presents greater thickness than is presented by bag regions located away from the marginal seal, the hanger comprising:

a flat supporting member formed with a plurality of elongated fingers (i) longitudinally extending from a rear portion thereof sufficiently far so as to span the length of the bag along its marginal seal and (ii) spaced parallel at a separation, one to the next, that is sufficient to permit the bag to be slid along lesser thickness regions of the bag located away from its marginal seal in directions in and out of a slot formed between adjacent elongated fingers, but that is insufficient to pass the greater thickness of the bag's marginal seal;

wherein the plastic bag may be slid within a slot between adjacent elongated fingers and suspended downhanging by the greater thickness of its marginal seal resting upon the adjacent elongated fingers.

2. The bag hanger according to claim 1 wherein the flat supporting member is formed with a multiplicity of spaced parallel elongated fingers defining slots between adjacent fingers that are separated, one to the next, sufficiently far so as to permit bags that are filled with contents, and that are correspondingly widened in regions of the contents, to be suspended downhanging at adjacent slots such that each filled bag should be individually independently slidable within and without its slot without interference to adjacent downhanging bags.

3. The bag hanger according to claim 1 further comprising:

a free-standing base member means, affixed to the supporting member, for sitting on a surface and for supporting the supporting member at a height above the surface sufficient to permit the bag to be suspended downhanging without contacting the surface.

4. The bag hanger according to claim 3 wherein the hanger means comprises:

a plurality of elongate legs resting level upon a planar surface in positions at least partially around a point where an imaginary line that is orthogonal to the surface and passing through the combined center of gravity of the hanger and a filled bag would intersect the plane of the surface; and a vertical column connecting the plurality of elongate legs and the rear portion of the supporting member.

5. The bag hanger according to claim 1 further comprising:

a hanger means, affixed to the supporting member, for mounting to a surface that is above the flat supporting member and for supporting by hanging the supporting member substantially flat, and for thereby supporting the bag that the supporting member in turn supports.

6. The bag hanger according to claim 5 wherein the hanger means comprises:

one or more brackets made from substantially planar material, each having a first surface that mounts to the surface above the supporting member and a second surface that extends downwards.

7. The bag hanger according to claim 6 wherein the one or more brackets are two in number and affix to opposite exterior ones of the plurality of elongated fingers.

8. The bag hanger according to claim 6 wherein the two brackets are adjustable in separation in the plane of the first surface that mounts to the surface above the flat supporting member.

9. The bag hanger according to claim 8 wherein the two brackets are adjustable in separation so as to span a one horizontal axis of a common planar flat refrigerator shelf.

10. The bag hanger according to claim 5 wherein the hanger means comprises:

one or more hook hangers made from slender rod material that mount to the surface above the flat supporting member by hooking features upon such surface.

11. The bag hanger according to claim 10 wherein the one or more hook hangers are four in number, are suitably adapted to hook the lattice members of a common lattice grid flat refrigerator shelf, and affix to a substantially rectangular supporting member for hanging it substantially flat at its four corners.

12. The bag hanger according to claim 1 wherein at least one slot formed between adjacent elongated fingers has a small area of the slot that is widened by presence of a void within the proximate surface of one or more of the adjacent elongated fingers, the widened small area of the slot presenting a small area where the seal of a bag suspended downhanging at the at least one slot from the adjacent elongated fingers need not invariably be maintained closed while the bag is so suspended.

13. The bag hanger according to claim 12 wherein the length of the bag along its seal, and the extent of the adjacent longitudinal fingers defining the at least one slot having the widened area, are both much greater than the diameter of a common drinking straw meanwhile that the small widened area is sufficient to permit a rod body approximately the diameter of a common drinking straw to pass between the interior and the exterior of the bag through an opening of the bag's seal at the widened region while the bag is suspended downhanging.

14. The bag hanger according to claim 13 further comprising:

a tabular conduit approximately the diameter of a common drinking straw passing as a rod body through an opening of the bag's seal at the widened region.

15. The bag hanger according to claim 14 wherein the tubular conduit comprises:

an elongate tube for flowing liquid.

16. The bag hanger according to claim 14 wherein the tubular conduit comprises:

a tube for flowing gases.

17. A substantially vertical hanger rack for bags exhibiting a marginal region, substantially in the shape of a straight bend, of increased thickness, the bag hanger rack comprising:

a substantially vertically tiered array of a plurality of bag hanger members, each member comprising two adjacent elongated fingers defining a slot sufficiently long so as to span the length of the bag along its marginal seal into which a lesser thickness region of a bag may be slid where the bag may thereafter be suspended downhanging at the slot by a resting of its increased thickness marginal region upon the adjacent elongated fingers.

18. The bag hanger rack according to claim 17 wherein the slots defined by the vertically tiered array of the plurality of bag hanger members are substantially aligned in a vertical plane.

19. The bag hanger rack according to claim 17 wherein a one of the adjacent elongated fingers of each of the plurality of bag hanger members is affixed to a corresponding one or ones of elongated fingers within one or more adjacent ones of the plurality of bag hanger members within the vertical array, the corresponding affixed ones of the elongated fingers providing a substantially rigid tiered structure to the bag hanger rack.

* * * * *